US008622564B2

(12) United States Patent
Chang et al.

(10) Patent No.: US 8,622,564 B2
(45) Date of Patent: Jan. 7, 2014

(54) PORTABLE ELECTRONIC DEVICE WITH INTERFACE

(75) Inventors: Sheng-Tien Chang, New Taipei (TW); Wen-Chieh Wang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 151 days.

(21) Appl. No.: 13/268,177

(22) Filed: Oct. 7, 2011

(65) Prior Publication Data

US 2012/0329313 A1 Dec. 27, 2012

(30) Foreign Application Priority Data

Jun. 27, 2011 (TW) ..... 100122388 A

(51) Int. Cl.
*F21V 33/00* (2006.01)

(52) U.S. Cl.
USPC ..... 362/95; 362/100; 362/249.05

(58) Field of Classification Search
USPC ..... 362/85, 94, 95, 100, 137, 147, 155, 362/249.05, 249.06, 276, 360, 364, 555, 362/602, 612, 613, 641, 642, 800, 802; 174/66, 67; 200/61.62, 310–317
See application file for complete search history.

(56) References Cited

U.S. PATENT DOCUMENTS

| | | | | |
|---|---|---|---|---|
| 5,874,693 | A * | 2/1999 | Rintz | 174/66 |
| 6,000,807 | A * | 12/1999 | Moreland | 362/95 |
| 6,350,039 | B1 * | 2/2002 | Lee | 362/95 |
| 6,593,530 | B2 * | 7/2003 | Hunt | 174/66 |
| 6,808,283 | B2 * | 10/2004 | Tsao | 362/95 |
| 7,009,111 | B1 * | 3/2006 | Rintz | 174/66 |
| 7,036,948 | B1 * | 5/2006 | Wyatt | 362/95 |
| 2007/0227867 | A1 * | 10/2007 | Yang | 200/310 |
| 2009/0284384 | A1 * | 11/2009 | Barton | 340/635 |

* cited by examiner

*Primary Examiner* — Hargobind S Sawhney
(74) *Attorney, Agent, or Firm* — Altis Law Group, Inc.

(57) ABSTRACT

An interface assembly includes a connector housing and a light emitting element. The connector housing defines a opening. The light emitting element is retained to the connector housing and illuminates the opening.

16 Claims, 3 Drawing Sheets

PORTABLE ELECTRONIC DEVICE WITH INTERFACE

BACKGROUND

1. Technical Field

The exemplary disclosure generally relates to portable electronic devices, particularly to portable electronic devices with external interfaces.

2. Description of Related Art

Electronic devices often provide an external port, such as an interface, enabling connection to a peripheral device, accessory, or network. However, the interface is typically small so it is difficult to connect the interface to the peripheral device, especially in a dark environment.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary portable electronic device with an interface. Moreover, in the drawings like reference numerals designate corresponding parts throughout the several views. Wherever possible, the same reference numbers are used throughout the drawings to refer to the same or like elements of an embodiment.

DETAILED DESCRIPTION

In this exemplary embodiment, the device is an electronic device such as a mobile telephone but any device employing an interface is applicable. Accordingly, any reference herein to the mobile telephone should also be considered to apply equally to other portable devices.

Figure 1:
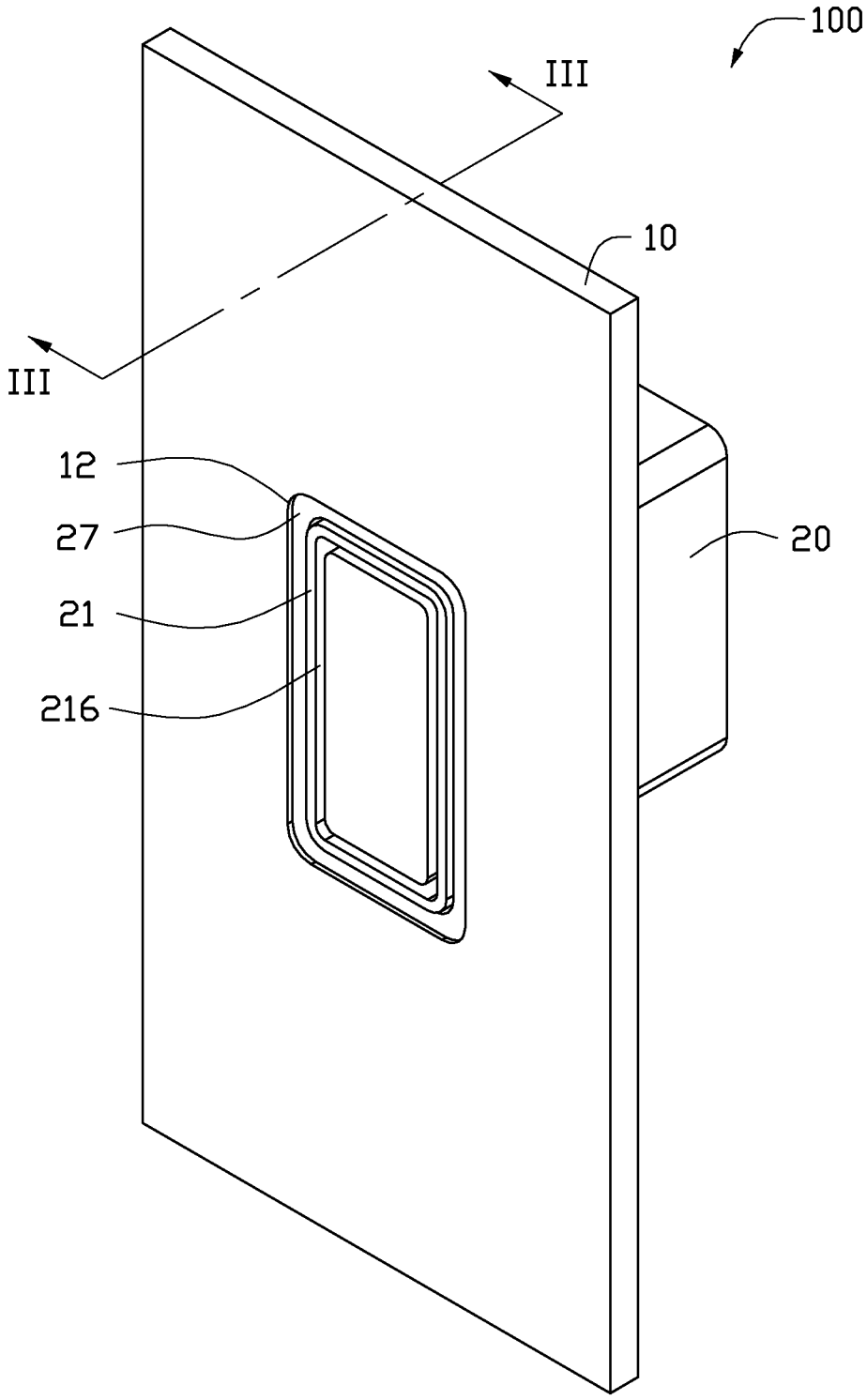
FIG. 1 is an assembled view of an exemplary embodiment of an electronic device including a cover plate and an interface.
Figure 2:
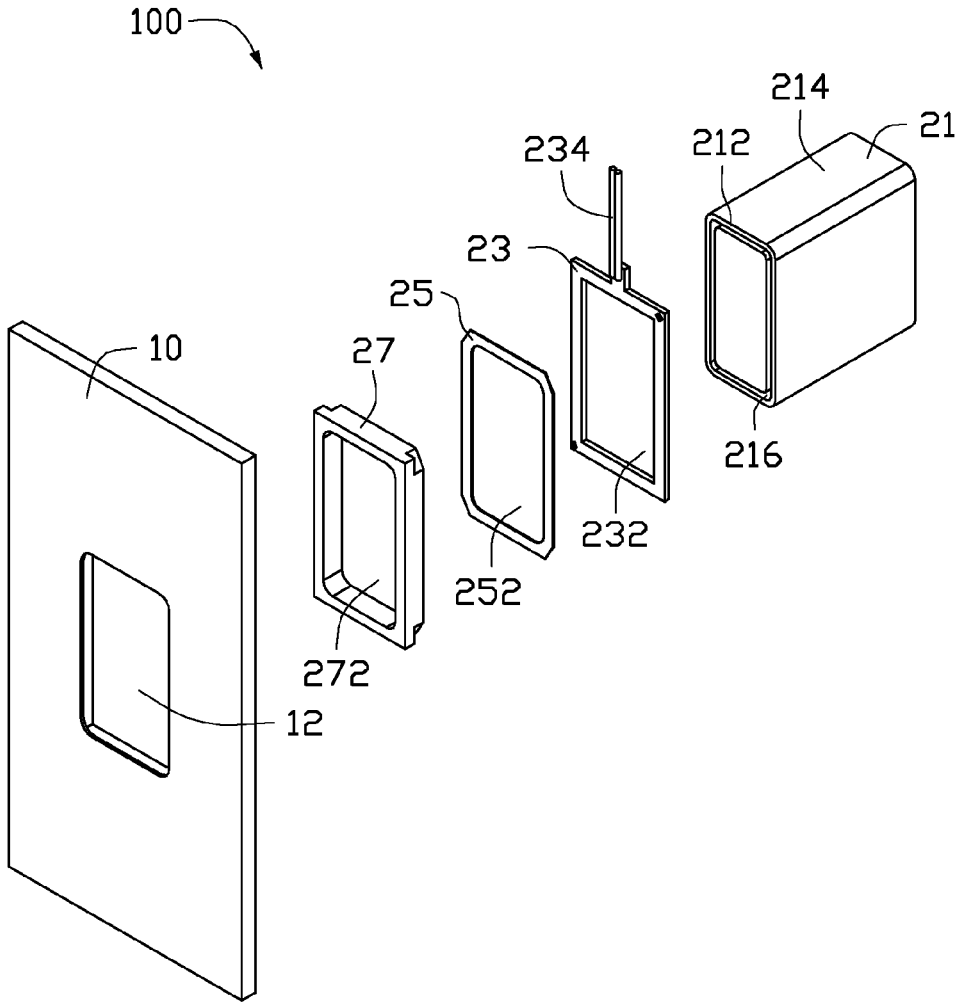
FIG. 2 is an exploded view of the electronic device of FIG. 1.

Referring to FIGS. 1 and 2, an exemplary electronic device 100 includes a cover plate 10 and an interface assembly 20 fixed to the cover plate 10. The cover plate 10 defines a retaining hole 12, in which the interface is located.

The interface assembly 20 includes a connector housing 21, a light emitting element 23, a light focusing element 25, and a light guiding element 27. The light emitting element 23, the light focusing element 25, and the light guiding element 27 are all retained to the connector housing 21, and the light focusing element 25 is located between the light emitting element 23 and the light guiding element 27.

Figure 3:
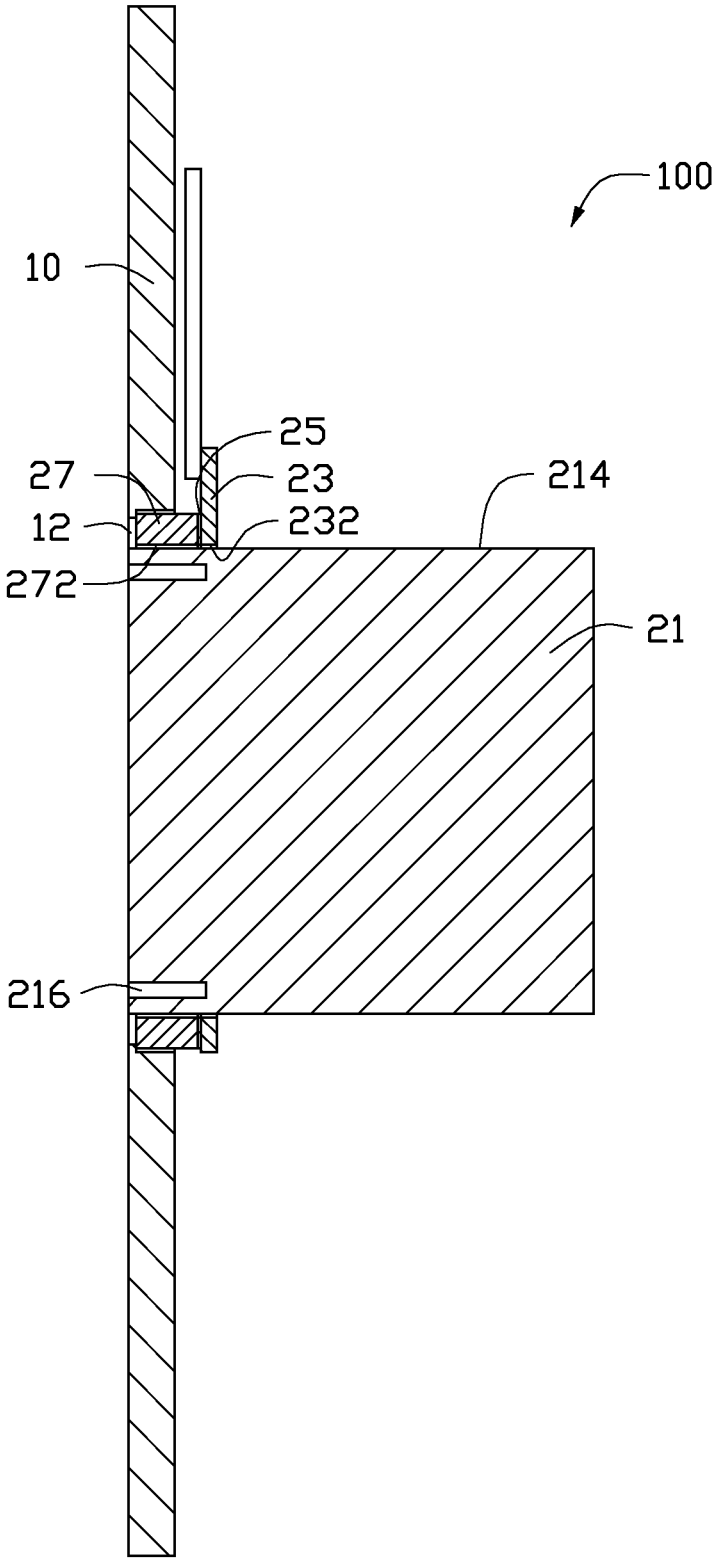
FIG. 3 is a cross-section of the electronic device shown in FIG. 1 along the line of III-III.

Referring to FIG. 3, the connector housing 21 contains a connector for connecting to a peripheral device, such as a power connector housing 21 or a USB connector housing 21. In this exemplary embodiment, the connector housing 21 includes an end wall 212, a peripheral wall 214 connected to the end wall 212, and a port 216 defined in the end wall 212. The port 216 is used to connect to the peripheral device.

The light emitting element 23 is used to illuminate the light guiding element 27. In this exemplary embodiment, the light emitting element 23 may be a light emitting diode (LED). The light emitting element 23 defines an opening 232 through its center portion. The connector housing 21 extends through and is located in the opening 232 so the light emitting element 23 surrounds the port 216 of connector housing 21. The light emitting element 23 further includes a conducting wire 234, to electrically connect the element 23 to a power (not shown) source of the electronic device.

The light focusing element 25 is located at/near one side of the light emitting element 23 for focusing the light emitting from the light emitting element 23 to the light guiding element 27. The light focusing element 25 may be made of silver. In this exemplary embodiment, the light focusing element 25 defines an orifice 252 through its center portion. The connector housing 21 extends through and is located in the orifice 252 so that the light focusing element 25 surrounds the port 216 of the connector housing 21.

The light guiding element 27 is located at/near one side of the light focusing element 25 opposite to the light emitting element 23, for guiding the light emitting from the light emitting element 23 out of the cover plate 10, to illuminate the connector housing 21. In this exemplary embodiment, the light guiding element 27 defines a trough 272 through its center portion. The connector housing 21 extends through and is located in the trough 272 so that the light guiding element 27 surrounds the connector housing 21. The light guiding element 27 may be made of transparent material, such as polyvinyl chloride (PVC), polycarbonate, polystyrene, or other thermoplastic resins. In another exemplary embodiment, the light guiding element 27 may be made of semi-opaque material, such as a mixture of resin and carbon to provide a colored decorative light for the cover plate 10.

In use, portions of the light emitted by the light emitting element 23 is transmitted to and focused by the light focusing element 25 until transmitted through the light focusing element 25, and reaching to and guided by the light guiding element 27, to illuminate the port 216 of connector housing 21. The rest of the light emitted by the light emitting element 23 is directly transmitted to and guided by the light guiding element 27, to illuminate the connector housing 21. Therefore, user can clearly see the connector housing 21 in a dark environment. It is to be understood that the light guiding element 27 and the light focusing element 25 can be omitted, the light emitted by the light emitting element 23 directly transmitted out of the cover plate 10 to illuminate the connector housing 21.

It is to be understood, however, that even through numerous characteristics and advantages of the exemplary disclosure have been set forth in the foregoing description, together with details of the system and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An interface assembly, comprising:

a connector housing defining a port; and a light emitting element retained to the connector housing and surrounding the port for illuminating the port;

a light guiding element for guiding the light emitting from the light emitting element to illuminate the connector housing; and a light focusing element located between the light emitting element and the light guiding element for focusing the light emitting from the light emitting element to the light guiding element.

2. The interface assembly of claim 1, wherein the light guiding element defines a trough through its center portion;

the connector housing passes through and is located in the trough so the light guiding element surrounds the port of the connector housing.

3. The interface assembly of claim 1, wherein the light guiding element is made of transparent material.

4. The interface assembly of claim 3, wherein the transparent material is one selected from polyvinyl chloride, polycarbonate and polystyrene.

5. The interface assembly of claim 1, wherein the light guiding element is made of opaque material.

6. The interface assembly of claim 5, wherein the opaque material is a mixture of resin and carbon.

7. The interface assembly of claim 1, wherein the light focusing element is made of silver.

8. The interface assembly of claim 1, wherein the light focusing element defines a orifice through its center portion; the connector housing passes through and is located in the orifice so the light focusing element surrounds the connector housing.

9. The interface assembly of claim 1, wherein the light emitting element defines an opening through its center portion; the connector housing passes through and is located in the opening so the light emitting element surrounds the connector housing.

10. An electronic device, comprising:

a cover plate defining a retaining hole; and an interface assembly retained in the retaining hole, the interface assembly comprising:

a connector housing defining a port; and a light emitting element retained to the connector housing and surrounding the port for illuminating the port;

a light guiding element for guiding the light emitting from the light emitting element to illuminate the connector housing; and a light focusing element located between the light emitting element and the light guiding element for focusing the light emitting from the light emitting element to the light guiding element.

11. The electronic device of claim 10, wherein the light guiding element defines a trough through its center portion; the connector housing passes through and is located in the trough so the light guiding element surrounds the connector housing.

12. The electronic device of claim 10, wherein the light focusing element is made of silver.

13. The electronic device of claim 10, wherein the light focusing element defines a orifice through its center portion; the connector housing passes through and is located in the orifice so the light focusing element surrounds the connector housing.

14. The electronic device of claim 10, wherein the light emitting element defines an opening through its center portion; the connector housing passes through and is located in the opening so the light emitting element surrounds the connector housing.

15. An interface assembly, comprising:

a connector housing defining a port; and a light emitting element retained to the connector housing and surrounding the port for illuminating the port;

a light guiding element for guiding the light emitting from the light emitting element to illuminate the connector housing; wherein the light guiding element is made of opaque material.

16. The interface assembly of claim 15, further comprising a light focusing element located between the light emitting element and the light guiding element for focusing the light emitting from the light emitting element to the light guiding element.

* * * * *